US005335754A

United States Patent [19]

Gibson

[11] Patent Number: 5,335,754

[45] Date of Patent: Aug. 9, 1994

[54] SELF-LEVELLING LADDER

[76] Inventor: Ross Gibson, 856 Finlayson Road, R.R. 6, Victoria, British Columbia, Canada, V9B 5T9

[21] Appl. No.: 94,985

[22] Filed: Jul. 22, 1993

[51] Int. Cl.[5] ..... E06C 7/44

[52] U.S. Cl. ..... 182/204; 182/205; 248/188.5

[58] Field of Search ..... 182/200–206; 248/188.5

[56] References Cited

U.S. PATENT DOCUMENTS

| | | | |
|---|---|---|---|
| 970,425 | 9/1910 | Curran | 182/205 |
| 3,527,321 | 9/1970 | Brown | 182/205 |
| 4,807,720 | 2/1989 | Kim | 182/205 |
| 5,082,088 | 1/1992 | Krause | 182/204 |
| 5,107,958 | 4/1992 | Johnson | 182/204 |
| 5,154,257 | 9/1992 | Mirles | 182/201 |
| 5,174,412 | 12/1992 | Vega | 182/204 |

FOREIGN PATENT DOCUMENTS

| | | | |
|---|---|---|---|
| 563847 | 9/1958 | Canada | 182/204 |
| 1232586 | 2/1988 | Canada | 228/13 |

*Primary Examiner*—Alvin C. Chin-Shue
*Attorney, Agent, or Firm*—Norman M. Cameron

[57] ABSTRACT

A self-levelling ladder has a pair of spaced-apart side rails and a plurality of spaced-apart rungs extending between the side rails. A pair of elongated sleeves slidably embrace the bottoms of the rails. Each sleeve has opposite sides. One of the sides has a plurality of spaced-apart teeth thereon. A pawl connected to each of the rails engages one of the teeth on one said sleeve.

1 Claim, 2 Drawing Sheets

SELF-LEVELLING LADDER

BACKGROUND OF THE INVENTION

1. Field of the Invention

This invention relates to ladders and more particularly to levellers on the bottoms of the side rails thereof for use on sloped or uneven surfaces.

2. Description of Related Art

Ladders frequently must be used on sloped or irregular surfaces. For example, ladders used on the exteriors of buildings often encounter sloped ground. On the insides of buildings, stairs present difficulties for ordinary ladders. In both circumstances the bottoms of the side rails may not contact the ground or floor simultaneously if the ladder is completely vertical. If the ladder is sloped to conform to the ground or floor, then it is likely to be unsafe.

Accordingly, several different types of apparatuses have been developed in the past in order to level the legs of a ladder so that they simultaneously contact uneven surfaces while the ladder is perfectly vertical. That is particularly important for long extension ladders where even a slight deviation from the vertical may cause the ladder to slip in use.

For example, U.S. Pat. No. 5,174,412 to Vega shows a ladder leveller which includes a member which engages the rungs of the ladder. There is a slidable leg mounted on the member and a plurality of matching apertures in the member and leg. A pin selectively locks the leg with respect to the member so that the leg extends a required amount below the ladder in order to level it.

U.S. Pat. No. 5,107,958 to Johnson shows a ladder leveller including a pair of sleeves which fit over the bottoms of the side rails. Threaded screw bolts are used to lock the sleeves in position so that they project a required amount below the side rails in order to level the ladder.

U.S. Pat. No. 5,154,257 to Mirles shows a ladder with a telescopically extending extension at the bottom each leg. These can be locked in a desired position to level the ladder by means of a number of different types of locking mechanisms.

While some of these prior art devices function satisfactorily, they typically suffer one or more drawbacks which limit their potential market and widespread acceptance. For example, many of these devices are relatively complicated and include many different components which must be assembled together. In other cases, installing the apparatus on a ladder may be difficult for the average person. Some of the apparatuses are heavy or make the ladder awkward to use.

SUMMARY OF THE INVENTION

It is an object of the present invention to provide a new and improved ladder levelling apparatus which minimizes the number of parts required.

It is another object of the present invention to provide an improved ladder levelling apparatus which is relatively light in weight.

It is another object of the invention to provide an improved ladder levelling apparatus which can be installed easily on a standard ladder by the average person.

It is a further object of the invention to provide an improved ladder levelling apparatus which does not interfere with normal operation of the ladder.

It is a still further object of the invention to provide an improved ladder levelling apparatus which automatically levels the bottoms of the side rails in order to accommodate unlevel or irregular surfaces.

In accordance with these objects, there is provided a ladder leveller comprising an elongated member having a top, a bottom and means for slidably embracing a leg of a ladder near the bottom thereof. There is an elongated slot in the member which extends between the top and the bottom. The member has a plurality of spaced-apart, shorter slots, each having an inner end communicating with the elongated slot. The shorter slots may be angled downwardly from the elongated slot towards the bottom of the member.

Another aspect of the invention provides a self-levelling ladder including a pair of spaced-apart side rails and a plurality of spaced-apart rungs extending between the side rails. There is a pair of elongated members, each freely embracing the bottom of one of the side rails. There is means for releasing each said elongated member to drop relative to the side rails below said rails when said each member is unsupported at the bottom thereof, and for holding said each member in position relative to the side rails when said each member is supported at the bottom thereof and a downward force is applied to the side rails or rungs of the ladder.

DESCRIPTION OF THE PREFERRED EMBODIMENTS

Figure 1:
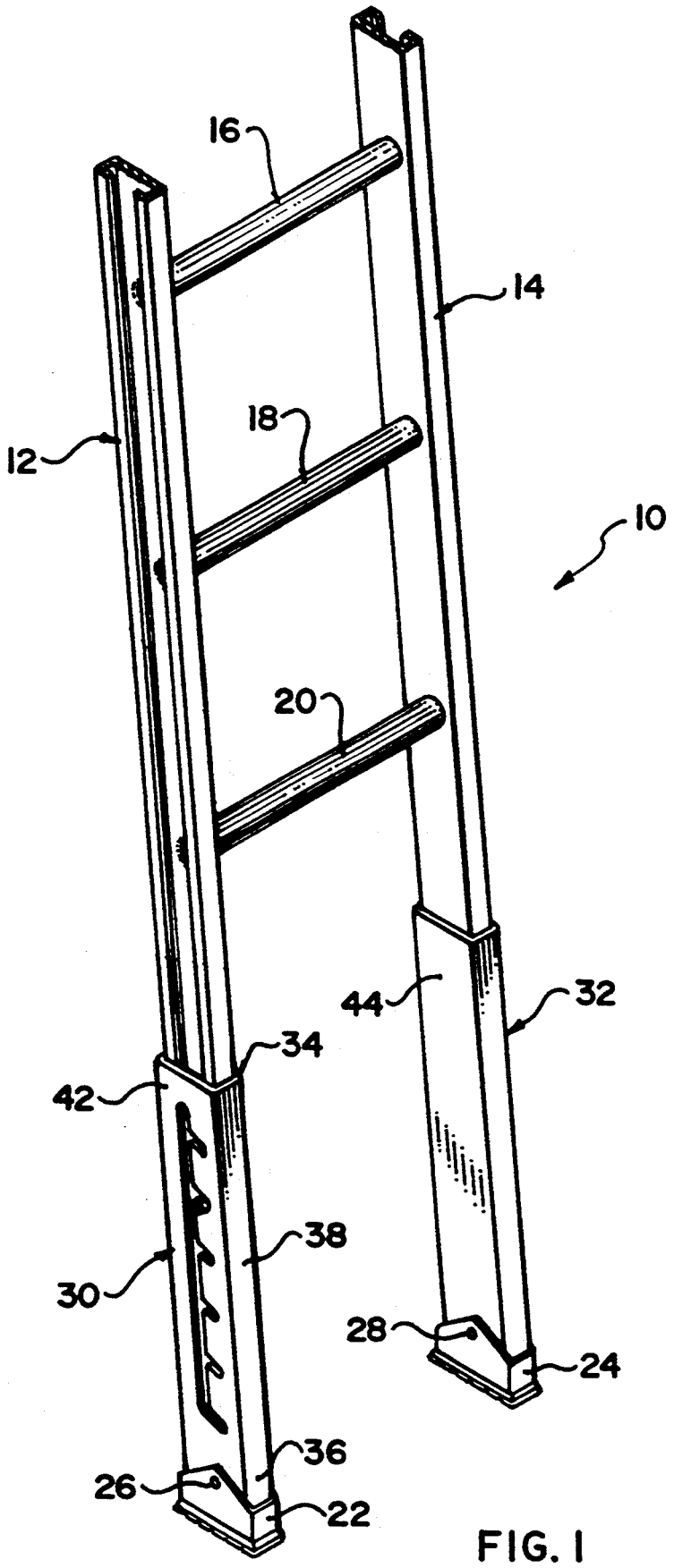
FIG. 1 is an isometric view of a self-levelling ladder with the upper portion of the ladder removed.

Referring first to FIG. 1, ladder 10 has a pair of spaced-apart side rails 12 and 14. In this example the side rails, which are also known as "legs", are aluminum channels, but wood or other materials could also be used. A plurality of spaced-apart rungs 16, 18 and 20 extend perpendicularly between the side rails. The rungs in this case are of aluminum tubing, but again other shapes of rungs and other materials could be substituted. The upper portions of the side rails and the upper rungs are removed in FIG. 1. The general configuration of the ladder as described thus far is conventional.

Extension ladders conventionally have pivotally mounted feet 22 and 24 on the bottoms of the side rails which are connected thereto by means of bolts 26 and 28. However, in the case of ladder 10 these feet are mounted instead on the bottoms of ladder levellers 30 and 32 by means of the bolts. The ladder levellers can be mounted on a standard extension ladder after the feet have been removed and preferably replaced on the bottom of the levellers.

Ladder levellers 30 and 32 each comprise a sleeve which slidably embraces the bottoms of the side rails. In the illustrated embodiment the sleeves wrap completely around the side rails. However, the term "sleeve"

should be interpreted broadly to include channels or other arrangements which freely embrace the side rails so as to permit the ladder levellers to slide up and down relative to the rest of the ladder.

Figure 2:
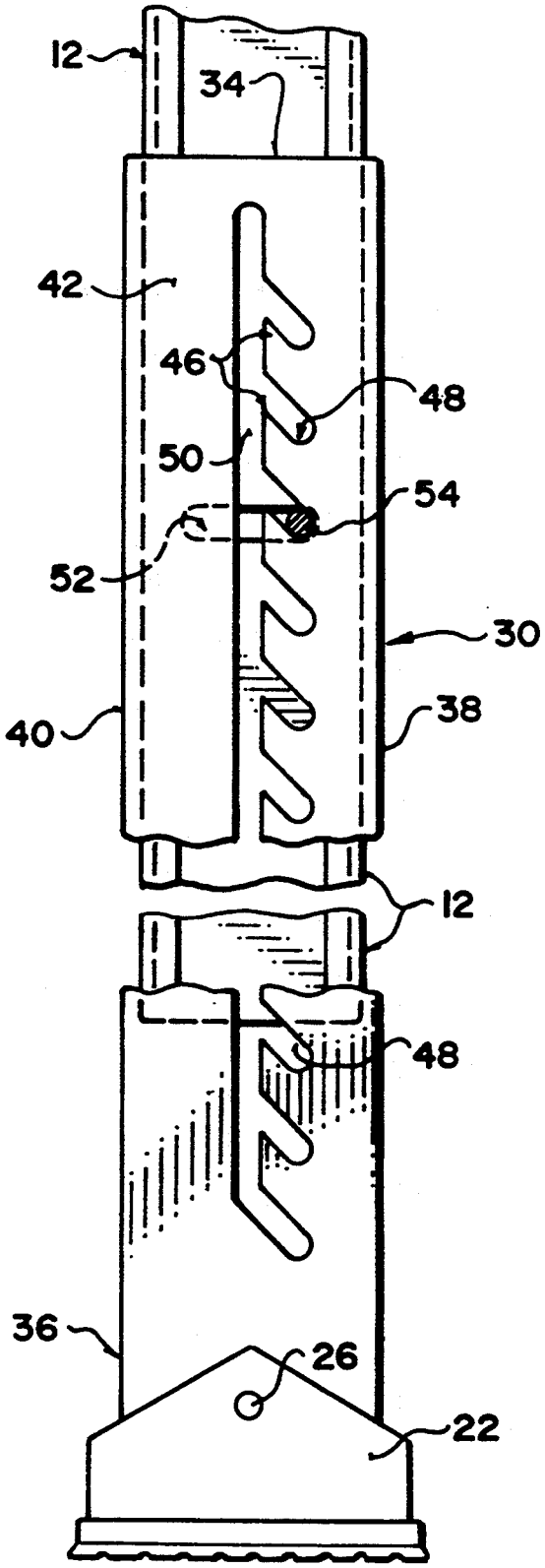
FIG. 2 is a side elevation of one of the ladder levellers of FIG. 1, shown partly broken away.

As shown for ladder leveller 30 in FIGS. 1 and 2, each leveller has a top 34, a bottom 36, a front 38, a back 40 and an outer side 42. As seen for leveller 32 in FIG. 1, each leveller also has an inner side 44.

There is a plurality of spaced-apart teeth 46 on the outer side of each leveller as seen best in FIG. 2. The teeth are angled upwardly towards the top of each leveller. They are separated by a plurality of short slots 48 which are angled downwardly towards the bottom of each ladder leveller. There is an elongated slot 50 which extends between the top and the bottom of each leveller. Each of the short slots 48 has an inner end which communicates with the elongated slot 50.

Figure 3:
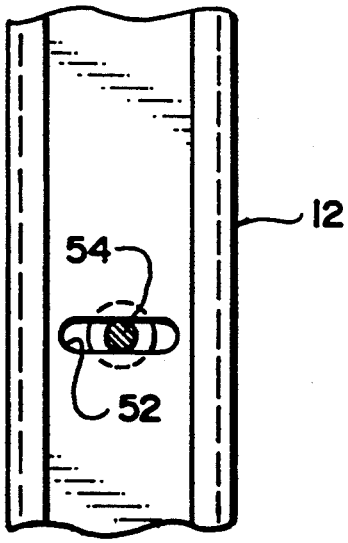
FIG. 3 is a fragmentary side elevation of one of the side rails of the ladder showing the elongated slot therein for receiving the pin which engages the teeth in the ladder leveller of FIG. 2.

As suggested above, apart from the two ladder levellers 30 and 32, ladder 10 is a conventional ladder and may be a preexisting unit with the ladder levellers being purchased separately. Alternatively however the entire ladder with the two levellers attached could be sold as a unit. In the former case, the feet 22 and 24 are first removed from the ladder and reinstalled by fitting the bolts 26 and 28 through apertures in the bottoms of the ladder levellers. An elongated slot 52 is cut in each side rail as shown for side rail 12 in FIG. 3. One ladder leveller is then fitted over the bottom of each side rail. A bolt 54 is then fitted through the slot 52 and one of the slots 48 or 50 in the ladder leveller. Other pin-like devices could be used in place of bolt 54. As may be seen in FIG. 3, the slot 52 is elongated in a direction which is horizontal when the ladder is erect. This allow the bolt 54 to move back and forth so it can fit into one of the slots 48 or into the slot 50.

In operation, if the ladder is on uneven ground and one of the feet 22 or 24 is above the ground and unsupported, then the appropriate ladder leveller 30 or 32 drops under its own weight. Initially the bolt 54 would be in a position, such as shown in FIG. 2, in one of the slots 48 between the teeth 46. When the ladder leveller drops, the bolt slides along the particular slot 48 and into the elongated slot 50. As the ladder leveller drops further, the bolt 54 can move upwardly in the slot 50 relative to the ladder leveller. Horizontal displacement of the bolt into the slot 50 is accommodated by the horizontally elongated slot 52 in the side rail.

After the foot 22 contacts the ground or other surface, the bolt 54 will be generally adjacent one of the slots 48. Downward pressure on the ladder or rung causes the bolt to move into one of the slots 48 between the teeth 46 which locks the ladder leveller in place. A slight amount of manual sideways pressure on the bolt may be necessary to initially move the bolt into the selected slot 48. Alternatively, a spring could be supplied to bias the bolt towards the slots 48.

It may be seen that the teeth 46 and bolt 54 constitute a linear ratchet with the bolt acting as a pawl. Other types of pawls or ratchet mechanisms could be substituted.

It will be understood by someone skilled in the art that many of the details described above are by way of example only and may be altered or deleted without departing from the scope of the invention as set out in the following claims.

What is claimed is:

1. A self-levelling ladder comprising:

a pair of spaced-apart side rails, each having a bottom portion, each said rail having an elongated slot in the bottom portion which is horizontal when the ladder is vertical;

a plurality of spaced-apart rungs extending between the side rails;

a pair of elongated sleeves, each said sleeve having a top and a bottom and slidably embracing the bottom portion of one of the rails, said each sleeve having opposite sides, one of said sides having an elongated slot extending between the top and the bottom of the sleeve and a plurality of spaced-apart sloping teeth thereon, the teeth being sloped upwardly towards the slot in said each sleeve when the ladder is erect, the teeth being separated by short, angled slots, the short slots communicating with elongated slot in said each sleeve; and a pawl connected to each of the rails of the ladder, each said pawl being a pin-like member slidably received in the elongated slot of one said side rail and being horizontally movable to engage or disengage from the teeth of one said sleeve.

* * * * *